US008744101B1

(12) United States Patent
Burns

(10) Patent No.: US 8,744,101 B1
(45) Date of Patent: Jun. 3, 2014

(54) SYSTEM FOR CONTROLLING THE PRIMARY LOBE OF A HEARING INSTRUMENT'S DIRECTIONAL SENSITIVITY PATTERN

(75) Inventor: Thomas Howard Burns, St. Louis Park, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 914 days.

(21) Appl. No.: 12/631,436

(22) Filed: Dec. 4, 2009

Related U.S. Application Data

(60) Provisional application No. 61/201,042, filed on Dec. 5, 2008.

(51) Int. Cl.
*H04R 25/00* (2006.01)
*H04R 5/00* (2006.01)
*H04R 3/00* (2006.01)

(52) U.S. Cl.
USPC ..... 381/313; 381/23.1; 381/92; 381/312

(58) Field of Classification Search
USPC ..... 381/60, 312–331, 23.1, 92, 356
See application file for complete search history.

(56) References Cited

U.S. PATENT DOCUMENTS 5,715,319 A 2/1998 Chu
2006/0291679 A1* 12/2006 Burns ..... 381/313
2009/0202091 A1* 8/2009 Pedersen et al. ..... 381/313

OTHER PUBLICATIONS

Lou, Fa-Long, et al., "Adaptive Null-Forming Scheme in Digital Hearing Aids", *IEEE Transaactions on Signal Processing,* vol. 50, No. 7, (Jul. 2002), 1583-1589.

* cited by examiner

*Primary Examiner* — Matthew Eason
(74) *Attorney, Agent, or Firm* — Schwegman, Lundberg & Woessner, P.A.

(57) ABSTRACT

Systems and method for computing in-situ estimates of the overall level and incoming direction of ambient acoustical energy by combining the output signals of at least one differential directional microphone and at least one omnidirectional microphone, or, multiple differential directional microphones, at specified gains, in order to have various polar pattern estimates for acoustical energy arriving from three or more sectors about the user. In one embodiment as many as eight different sectors about the user, including the front, rear, and sides are used. In various embodiments, front, rear and/or side or portions thereof are used. Other numbers of sectors are possible without departing from the scope of the present subject matter.

20 Claims, 10 Drawing Sheets

| | OMNIDIRECTIONAL | BIDIRECTIONAL | CARDIOID | HYPERCARDIOID | SUPERCARDIOID |
|---|---|---|---|---|---|
| |  |  |  |  |  |
| DI (dB) | 0 | 4.8 | 4.8 | 6.0 | 5.7 |
| UI(dB) | 0 | 0 | 8.4 | 8.4 | 11.4 |
| FTR | 0.5 | 0.5 | 0.88 | 0.87 | 0.93 |
| −3dB ARC | / | ±45° | ±66° | ±53° | ±58° |
| −6dB ARC | / | ±60° | ±90° | ±71° | ±78° |
| dB @ 90° | 0 | −∞ | −6 | −12 | −8.6 |
| dB @ 180° | 0 | 0 | −∞ | −6 | −11.7 |

| DEGRADED PATTERN DUE TO MISMATCH | 250Hz | 500Hz | 1kHz | 2kHz | 4kHz |
|---|---|---|---|---|---|
|   | 0.3dB | 0.6dB | 1.1dB | 1.3dB | 2.4dB |
|   | 2° PHASE (22μSEC) | 4° PHASE (22μSEC) | 8° PHASE (22μSEC) | 16° PHASE (22μSEC) | 32° PHASE (22μSEC) |

| DEGRADED PATTERN DUE TO MISMATCH | 250Hz | 500Hz | 1kHz | 2kHz | 4kHz |
|---|---|---|---|---|---|
|  | 6.3dB | 6.3dB | 6.3dB | 6.3dB | 6.3dB |
|  | 16.0dB | 16.0dB | 16.0dB | 16.0dB | 16.0dB |
|  | 90° PHASE (1ms) | 90° PHASE (500μs) | 90° PHASE (250μs) | 90° PHASE (125μs) | 90° PHASE (63μs) |

SYSTEM FOR CONTROLLING THE PRIMARY LOBE OF A HEARING INSTRUMENT'S DIRECTIONAL SENSITIVITY PATTERN

CLAIM OF PRIORITY

The present application claims the benefit under 35 U.S.C. 119(e) of U.S. Provisional Patent Application Ser. No. 61/201,042, filed Dec. 5, 2008, which is incorporated herein by reference in its entirety.

TECHNICAL FIELD

This application relates generally to hearing assistance listening devices, and more particularly to systems and methods for controlling the primary lobe of a hearing instrument's directional sensitivity pattern via estimates of sound energy arriving from different spatial sectors.

BACKGROUND

For hearing loss, a clinically proven method to increase speech intelligibility in ambient noise is to provide the user with directional hearing instruments. In general, directional microphone systems are configured as either endfire or broadside. In (freefield) endfire configurations, the maximum response angle (MRA) can point to either 0° for the case of a unidirectional response, to 180° for the case of an inverted unidirectional, or to both in the case of a bidirectional (figure of eight). It is not possible to shift the MRA of a (freefield) endfire unidirectional to any other angle, regardless of signal processing. When a forward-pointing unidirectional is worn in-situ, the MRA shifts from its freefield value of 0° to a different angle based on head and torso acoustical scattering; it is still not possible to shift its MRA any other forward-pointing angle via signal processing. In (freefield) broadside configurations, the MRA can be shifted to any angle, however, the shiftable frequency range is related to the separation distance of the outer microphones. For in-the-ear (ITE) and behind-the-ear (BTE) hearing instrument applications, this separation distance is too small to provide any substantive directionality. Consequently, broadside directional microphone systems have not been used by manufacturers of hearing instruments, with the exception of some integrated eyeglass devices described in technical research papers. It would be advantageous, therefore, to have the ability to shift and control the MRA of a hearing instrument.

One figure of merit used to benchmark the directional gain of a hearing instrument is the Directivity Index (DI). The DI can be regarded as a Signal-to-Noise Ratio (SNR) captured under two different acoustical conditions. In the first condition, the 'signal' is computed from acoustic energy arriving from the front 0° angle (i.e., on-axis target direction); this condition can be simulated only in a perfectly anechoic space. In the second condition, the 'noise' is computed from isotropic energy (i.e., temporally uncorrelated planar wavefronts arriving with equal amplitude from all directions); this condition does not exist physically and can only be simulated in: 1) a sufficiently reverberant field in which case the isotropic noise estimate is the temporal average of a single measurement of incoherent wavefronts, or 2) an anechoic space with a loudspeaker positioning/scanning apparatus in which case the isotropic noise estimate is the spatial average of multiple measurements of coherent wavefronts. It is interesting to note that the DI is computed under conditions that the user will never encounter; these conditions are used simply because they can be reproduced with relative ease in any laboratory setting—thereby providing a level playing field for manufacturers to compute a DI and benchmark the directional performance of their product.

An optimized DI in isotropic noise (sometimes referred to as a spherically 'diffuse' field) is 6 dB. In other words, the highest directional gain that can be achieved in a spherically-diffuse field for a $1^{st}$-order differential microphone is 6 dB. The only environments with excessively-reverberant fields ($T_{60}\approx 10$ seconds) that remotely approach the statistical properties of a spherically-diffuse field exist in laboratories accredited for standard ASTM C423 or ISO 3741 measurements. Typical indoor environments ($T_{60}\approx 1$ second) encountered by a hearing-instrument user have been described as 'cylindrically' diffuse, i.e., the reverberation arrives at the user from all walls of the room while the floor and ceiling reflections are attenuated due to carpet and sound-absorptive suspended ceiling tiles. The highest theoretical directional gain achievable in a cylindrically-diffuse field for a $1^{st}$-order differential microphone is 4.8 dB. The DI as measured in a laboratory environment, therefore, yields a biased estimate of the actual directional gain for a user in a typical indoor environment. To recapitulate, an anechoic or spherically-diffuse acoustical environment is unique to a laboratory; a real-world reverberant environment is not spherically-diffuse and has properties ranging somewhere between anechoic and spherically-diffuse. It would, therefore, be advantageous to process the microphone signals of a hearing instrument in order to estimate the type of environment the user is exposed to: Is it cylindrically diffuse, or better yet, what direction does the majority of ambient noise arrive from? Such an estimate could provide a better procedure for controlling the instantaneous directional response of the hearing instrument.

There are a number of additional benchmarks that have been used to characterize the directional performance of microphone systems. Intrinsically, these benchmarks are based on various free-field sound energy ratios and are expressed either as decimals or decibels. One laboratory benchmark is the Unidirectional Index (UI) expressed as the dB ratio of average sound energy arriving from the user's front half sphere to the average sound energy arriving from the user's rear half sphere. Another laboratory benchmark is the Front to Total Random (FTR) ratio expressed as the decimal ratio of average sound energy arriving from the user's front half sphere to the average sound energy arriving from all directions. In addition to the free-field energy ratios, there are a number of $1^{st}$-order directional sensitivity patterns typically referenced by manufacturers; these patterns include the hypercardiod which optimizes the DI and the supercardioid which optimizes the FTR. Each optimization is assumed in a spherically-diffuse field. For reference, a table summarizing the properties of these polar patterns is shown in FIG. 1. It is interesting to note that a bidirectional polar pattern has the same DI as a cardioid polar pattern, and the same FTR as an omni, thereby revealing the limitations of a DI or FTR alone to benchmark directional behavior and performance. Only in their entirety and relation are these benchmarks definitive.

In addition to the above-referenced benchmarks related to spherically or cylindrically-diffuse fields, there are benchmarks that are independent of the acoustical environment and capture intrinsic directional performance. For example, the −6 dB point of the primary directional lobe is a performance parameter that is independent of a spherically-diffuse or cylindrically-diffuse environment. Similarly, the sensitivity ratio at 180° to the sensitivity at 0° is independent of the acoustical environment. Such benchmarks do not require a spatial integration of sound energy, they're simply the measured response ratio of wavefronts arriving from certain directions. Thus, a cardioid polar pattern is a cardioid polar pattern, regardless of what environment it is in. The directional gain it provides to the user, however, is a function of the amount of ambient noise and the direction from which it arrives—relative to the spatial orientation of the polar sensitivity pattern. It would be advantageous, therefore, to compare the relative sound energy estimates from a number of (in-situ) fixed, directional polar responses to predict the properties of the user's acoustical environment. The simplest fundamental approach is to estimate the ambient sound energy arriving from the front (−90°→90° in azimuth), the left) (180°→360°, the right)(0°→180°, and the rear)(90°→270°, where 0° is synonymous with 360°.

It was noted previously that real-world acoustic environments are not spherically diffuse. For this reason, it seems rather specious that directivity indices optimized for spherically-diffuse conditions have been used exclusively to predict directional benefit of hearing instruments. A clinical question often asked is: What is the best pattern for the user? The answer should begin with another question: What acoustical environment is the user in? More specifically, where is the target and where is the ambient noise? Certainly, a person driving a car who is trying to hear speech from a passenger in the front seat would benefit more from a right-pointing cardioid than a forward-pointing hypercardioid (except in England, of course). For this reason, it would be advantageous to have a directional processing system that could estimate both the location of the target signal and direction of incoming ambient noise, and adjust the user's audio signal by controlling the MRA and optimizing the SNR with a polar pattern for each particular acoustical environment—regardless as to whether the ambient noise is spherically-diffuse, cylindrically-diffuse, or anything in between. The simplest fundamental approach could assume that the target is always at 0° on-axis, and that the ambient noise is predicted from the energy estimates described previously.

Traditionally, two approaches have been used to adjust the SNR for a hearing instrument. The first approach compares the output signals of both an omnidirectional microphone and a separate differential directional microphone. These two signals alone are used to control an algorithm to switch the audio output from omnidirectional mode (typically used in quiet environments) to directional mode (noisy environments) via a simple linear or logarithmic pan. This approach has been referred to as 'dynamic' directionality. It is robust in that the output signal from the $1^{st}$-order differential microphone provides a directional polar pattern that is very stable to electroacoustical drift. It is limited in that only two estimates are used in controlling the switch from omni to directional modes. For this reason, it would be advantageous to use additional sound energy estimates to characterize the user's acoustical environment and adjust the final polar pattern provided to the user.

The second approach uses two omnidirectional mics in an endfire configuration. The output signal of either mic provides the omnidirectional mode and the output signal of the rear mic is inverted, temporally delayed, and summed with the front mic to provide a static, directional mode of operation. With DSP, the temporal delay can be adjusted to shift the null angle of the polar pattern until a certain signal (usually the omni output) to noise (usually the inverted, delayed-and-summed output) ratio is optimized. This approach has been referred to as 'adaptive' directionality. It is robust in that the actual polar pattern provided to the user doesn't need to be known computationally; the algorithm simply adjusts the time delay until a null is steered to some noise source (jammer) and a certain SNR estimate is reached. It is limited in that the target is typically assumed to be 0° on-axis and the electrical mismatch of the front and rear channels (dominated by electroacoustical mismatch of the mics) needs to be tightly controlled. To remedy mic mismatch due to drift, elaborate schemes for in-situ mic matching have been patented; marketing literature for adaptive directionality typically includes references to these proprietary schemes.

In general, mic mismatch manifests itself in a $1^{st}$-order endfire configuration as follows: sensitivity mismatch degrades the null and phase mismatch shifts the null angle. If mismatch is not managed properly, the directional algorithm can mistakenly shift the null to the 0° on-axis target or the algorithm can lose its ability to provide any semblance of a null altogether. For a 1 cm spaced endfire hypercardioid in a spherically-diffuse field, FIG. 2 shows the independent sensitivity mismatch (0.6 dB at 500 Hz) that would yield 2 dB degradation in the DI and the independent phase mismatch (constant time delay of 22 μsec) that would shift the null angle to 54° off-axis (i.e., a supercardioid pointing backwards).

SUMMARY

Various embodiments provide a directional processing scheme that is: less sensitive to electroacoustical drift, less-likely to mistakenly steer a null toward the 0° on-axis target, capable of characterizing the incoming direction, level, and diffusivity of ambient sound arriving from the user's environment, capable of characterizing the incoming direction and level of the sound target, capable of shifting the MRA of a user's polar pattern, and capable of controlling a user's polar pattern that is best-suited for the acoustical environment.

Within a hearing instrument, the present subject matter uses at least one differential directional microphone and at least one omnidirectional microphone, or, multiple differential directional microphones, a digital signal processing (DSP) strategy that combines the outputs of the aforementioned microphones at various gains in order to compute acoustical energy estimates related to the incoming direction of ambient noise, and a DSP strategy that uses these aforementioned estimates to provide the most appropriate audio signal to the user by controlling the most appropriate polar pattern—based on the acoustical energy estimates of the user's environment and any other cognitive or temporal characteristics that can be estimated from the aforementioned microphone output signals.

Various embodiments provide a method for adjusting the directional polar pattern of a hearing instrument by estimating the overall level and incoming direction of ambient acoustical energy.

Various embodiments provide a method for computing in-situ estimates of the overall level and incoming direction of ambient acoustical energy by combining the output signals of at least one differential directional microphone and at least one omnidirectional microphone, or, multiple differential directional microphones, at specified gains, in order to have various polar pattern estimates for acoustical energy arriving from three or more sectors about the user. In one embodiment as many as eight different sectors about the user. In various embodiments the front, rear, sides, and portions thereof, are used. Other numbers of sectors are possible without departing from the scope of the present subject matter.

Various embodiments provide a method for optimizing various ratios of front, rear, left, and right acoustical energy estimates.

Various embodiments provide a method for applying temporal and/or cognitive estimates to the front, rear, left, and right energy estimates in order to break down the estimates into smaller subsets, e.g., noise from the left, speech from the right, music from the front, etc., and provide detailed characteristics of the noise and/or target.

Various embodiments provide a method of applying the aforementioned estimates independently in smaller frequency bands.

Various embodiments provide a method of combining the aforementioned estimates binaurally.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

The following detailed description of the present subject matter refers to the accompanying drawings which show, by way of illustration, specific aspects and embodiments in which the present subject matter may be practiced. These embodiments are described in sufficient detail to enable those skilled in the art to practice the present subject matter. Other embodiments may be utilized and structural, logical, and electrical changes may be made without departing from the scope of the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The recording arts industry has a long history of recording classical music ensembles with variable-pattern microphones. Most notable is the pioneer work of Blumlein in the 1930's. The output signal of a bidirectional (figure of eight) microphone cartridge pointing at −45° can be mixed with the signal of another bidirectional pointing at +45° to yield a unique polar pattern. Cardioids can be used instead of the aforementioned bidirectionals, or the signal from an omnidirectional microphone can be mixed with the signal of any 1st-order differential microphone. Regardless, by mixing the cartridge outputs, an overall polar pattern is obtained that is different than the unique pattern of either cartridge, thereby allowing the recording producer to adjust the direct energy from the ensemble to the reverberant energy from the architecture. Different patterns are used in different concert halls based on the location of the microphones, the direct-to-reverberant sound energy, the texture of the music, the architectural acoustics of the space, and the artistic goals of the producer. Historically, mixing was done electrically within the multi-cartridge microphone; the overall pattern was chosen with an electrical switch on the mic and the mixed output was recorded either to stereo tape or to stereo vinyl. This approach was used simply because postproduction mixing of individual cartridge recordings would have introduced too much noise from the recording mediums of the time. With the advent of digital storage, noise is no longer a concern. The current practice is to digitize the outputs of both cartridges separately so that the producer can mix them at a later time and experiment with various polar patterns. For example, one polar pattern may best be suited for the Allegro section whereas a different pattern may best be suited for the Andante, thereby providing more flexibility for the producer to achieve a particular effect.

Figure 3:
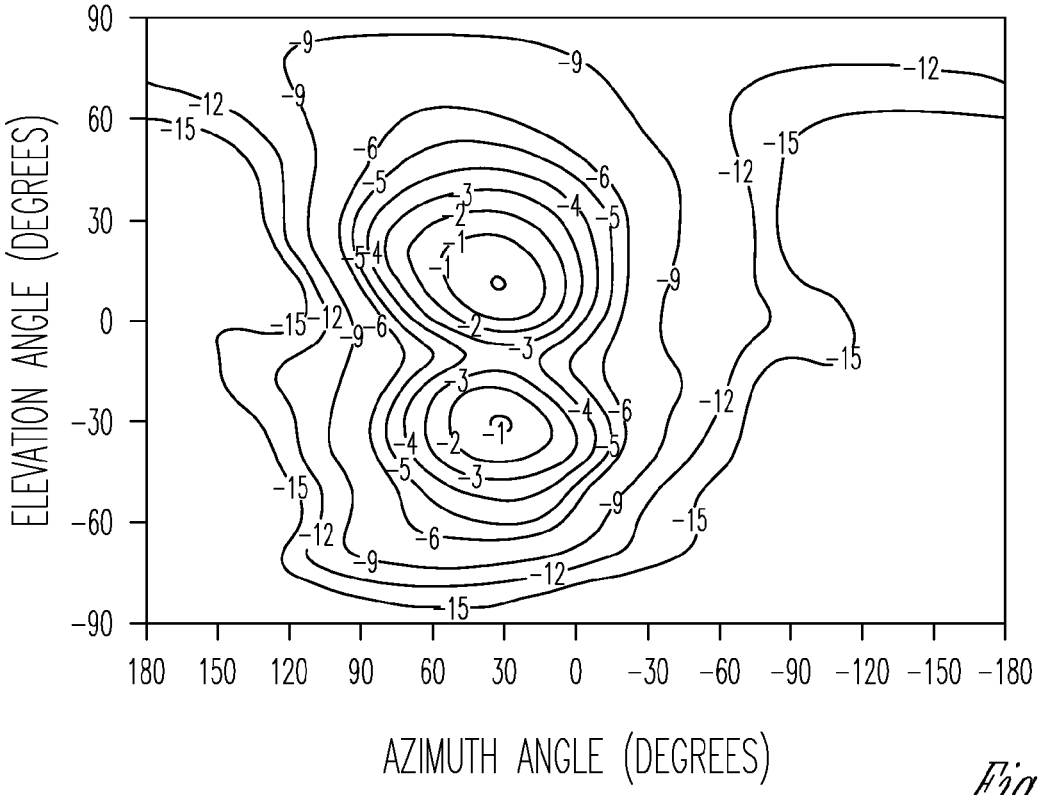
FIG. 3 illustrates KEMAR's in-situ, three-dimensional sensitivity pattern $E_f=|G_oH_o-G_dH_d|$ at 2 kHz of an ITE microphone system having an omnidirectional mic and a $1^{st}$-order bidirectional differential microphone when the relative microphone sensitivities are $G_d=G_o+8$ dB.
Figure 4:
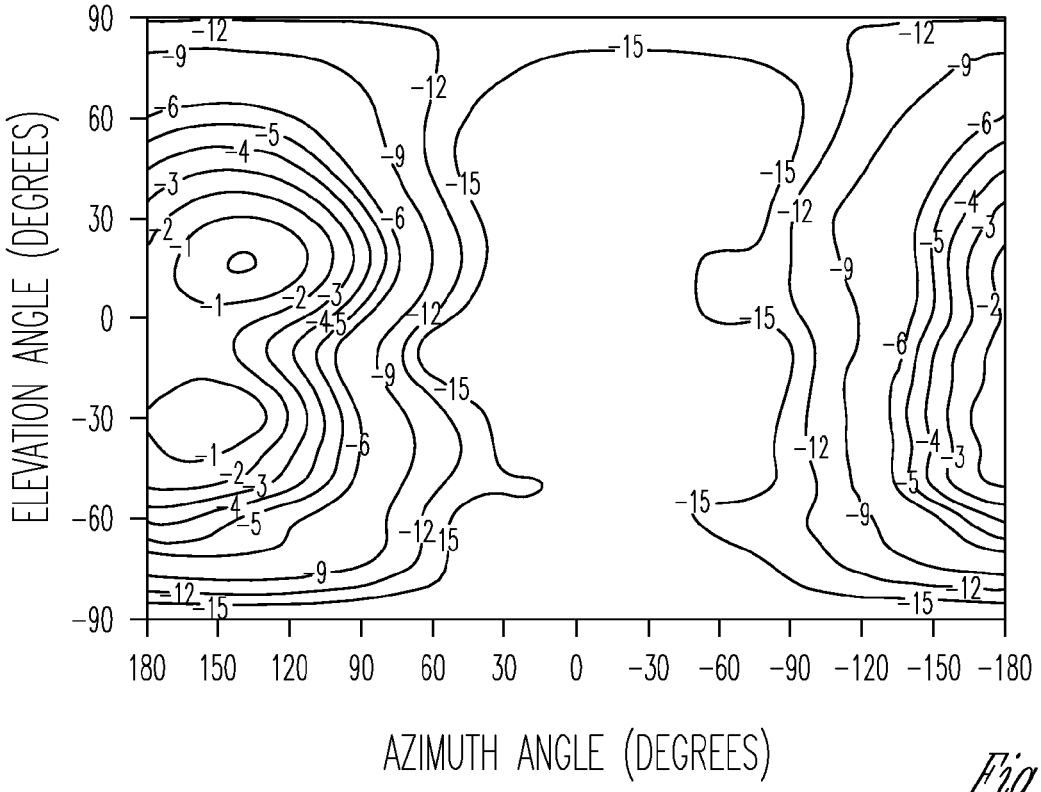
FIG. 4 illustrates KEMAR's in-situ, three-dimensional sensitivity pattern $E_r=|G_oH_o+G_dH_d|$ at 2 kHz of an ITE microphone system having an omnidirectional mic and a $1^{st}$-order bidirectional differential microphone when the relative microphone sensitivities are $G_d=G_o+6$ dB.
Figure 5:
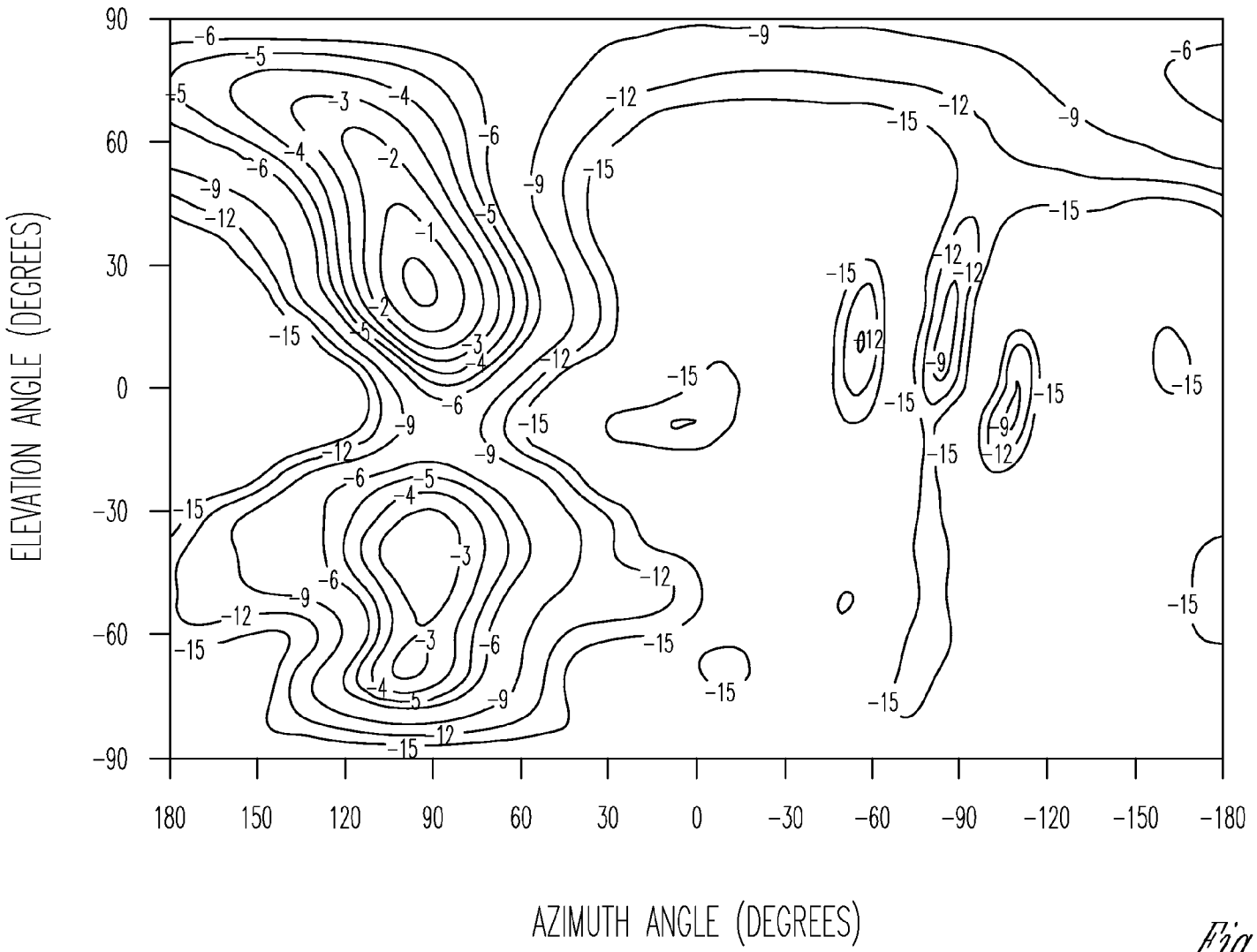
FIG. 5 illustrates KEMAR's in-situ, three-dimensional sensitivity pattern $E_s=G_o|H_o|-G_d|H_d|$ at 2 kHz of an ITE microphone system having an omnidirectional mic and a $1^{st}$-order bidirectional differential microphone when the relative microphone sensitivities are $G_d=G_o+6$ dB.

Similarly, the outputs of multiple microphones in a hearing instrument can be combined to yield an overall directional pattern. Hereinafter, this will be referred to as a Blumlein response. If each mic is summed with a certain gain, an overall polar response can be achieved. With DSP, multiple polar responses can be estimated independently from the audio output sent to the user. In addition, head and torso related acoustical scattering effects can be included in the polar response estimates. For example, FIG. 3 illustrates the in-situ measured results on KEMAR of one possible summing method. For these particular data, the omnidirectional microphone signal Ho, which is a function of azimuth and elevation angle, is weighted by Go and the directional microphone signal Hd, also a function of azimuth and elevation angle, is weighted by Gd. The signals are combined with relative gains Gd=Go+8 dB to provide an in-situ energy estimate Ef=|GoHo−GdHd| for acoustic energy arriving from the front of KEMAR. Other gains can be used to yield other polar patterns. In FIG. 4, for example, the signals are combined with relative gains Gd=Go+6 dB to provide an in-situ energy estimate Er=|GoHo+GdHd| for acoustic energy arriving from the rear of KEMAR. In FIG. 5, the signals are combined with relative gains Gd=Go+6 dB to provide an in-situ energy estimate Es=Go|Ho|−Gd|Hd| for acoustic energy arriving from the side of KEMAR. It should be noted that it is not particularly important that the above-referenced estimates correspond to the physical acoustic potential or kinetic energies; the directional characteristics of the energy-related estimate is more important. Though irrelevant for this discussion, it should be noted that these data were acquired with an omnidirectional mic whose absolute sensitivity was within 2 dB of the absolute sensitivity of the bidirectional mic when measured on-axis, in freefield at 1 kHz; their sensitivity disparity at other frequencies varied many dB, as expected, for typical omni/bidirectional hearing aid electret mics. For this discussion, disparity in the absolute sensitivity would simply alter the relationship between Go and Gd above; the concepts remain unchanged.

Figure 6:
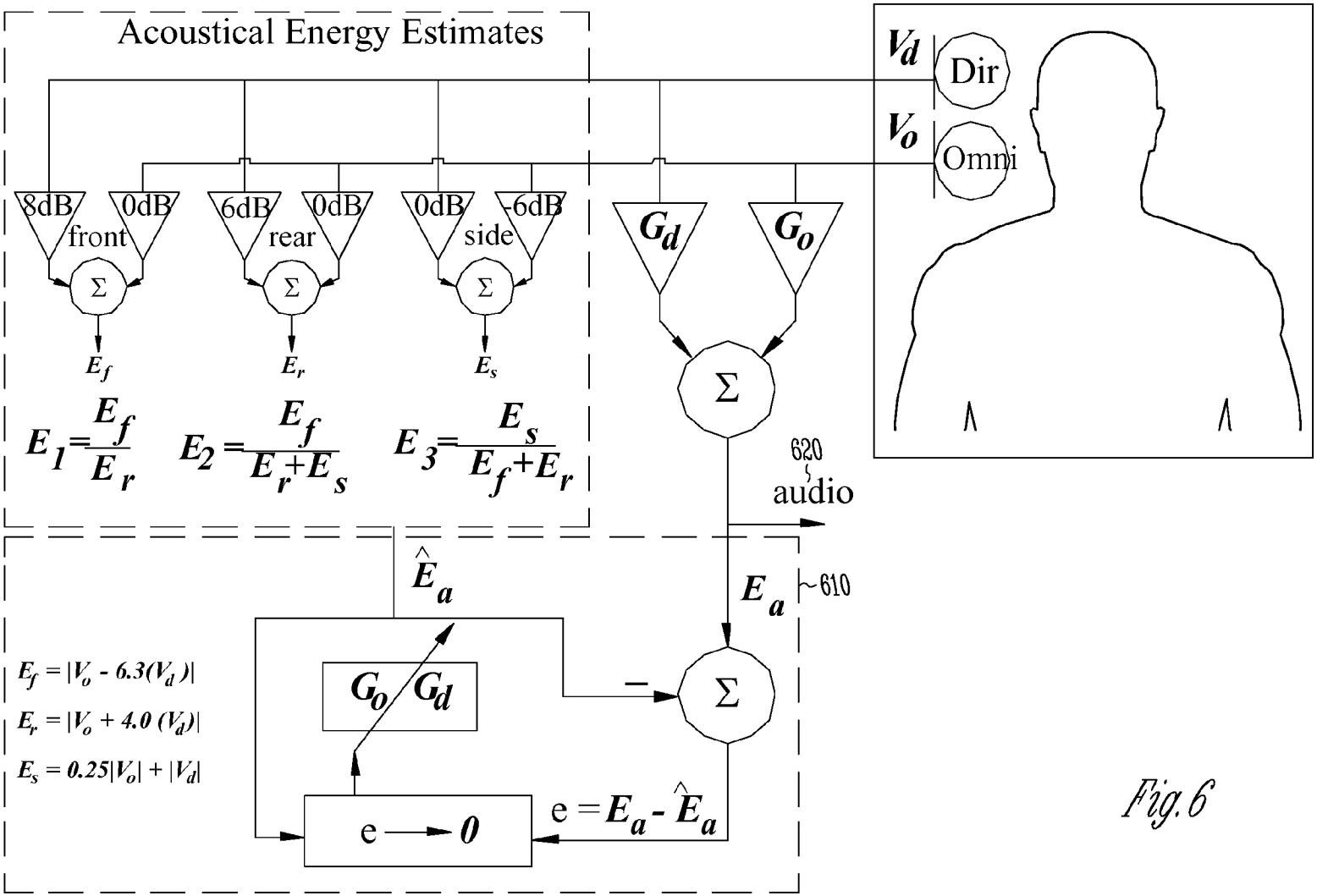
FIG. 6 illustrates a signal processing diagram for controlling the directional polar pattern of a hearing instrument based on ambient acoustical energy estimates according to one embodiment of the present subject matter.

One method of controlling the directional polar pattern of a hearing instrument based on acoustical energy estimates related to the incoming direction of ambient noise is shown in FIG. 6. It should be noted in FIG. 6 that there are two sets of weighting gains for the microphones. The output signals from the omni and directional microphones are weighted by a certain gain and summed to compute estimates for acoustical energy arriving from the front, rear, and side. The front, rear, and side estimates are used to compute energy ratios, and these ratios are used to compute a desired acoustical energy estimate $\hat{E}_a$. The desired estimate $\hat{E}_a$ is compared to the user's audio output signal Ea and also used in a control algorithm to adjust the relative mic gains Gd and Go in order to minimize the error between $\hat{E}_a$ and Ea.

FIG. 6 shows that the outputs of a directional microphone and an omnidirectional microphone are used to generate front, rear, and side energy estimates (Ef, Er, and Es). These estimates are used to generate three signals (E1, E2, and E3) where:

$$E1=Ef/Er$$

$$E2=Ef/(Er+Es)$$

$$E3=Es/(Ef+Er)$$

In the example of FIG. 6, Ef=absolute value of (Vo−6.3 Vd), Er=absolute value of (Vo−4.0 Vd) and Es=(0.25*absolute value of (Vo))+absolute value of (Vd), Where Vo is the output of the omnidirectional microphone and Vd is the output of the directional microphone.

Thus, the outputs of the adaptive filter 610 are the relative microphone gains Go and Gd. The output of the system is audio signal 620. As the system processes sound from the microphones, Gd and Go will adapt to provide an output.

Figure 7:
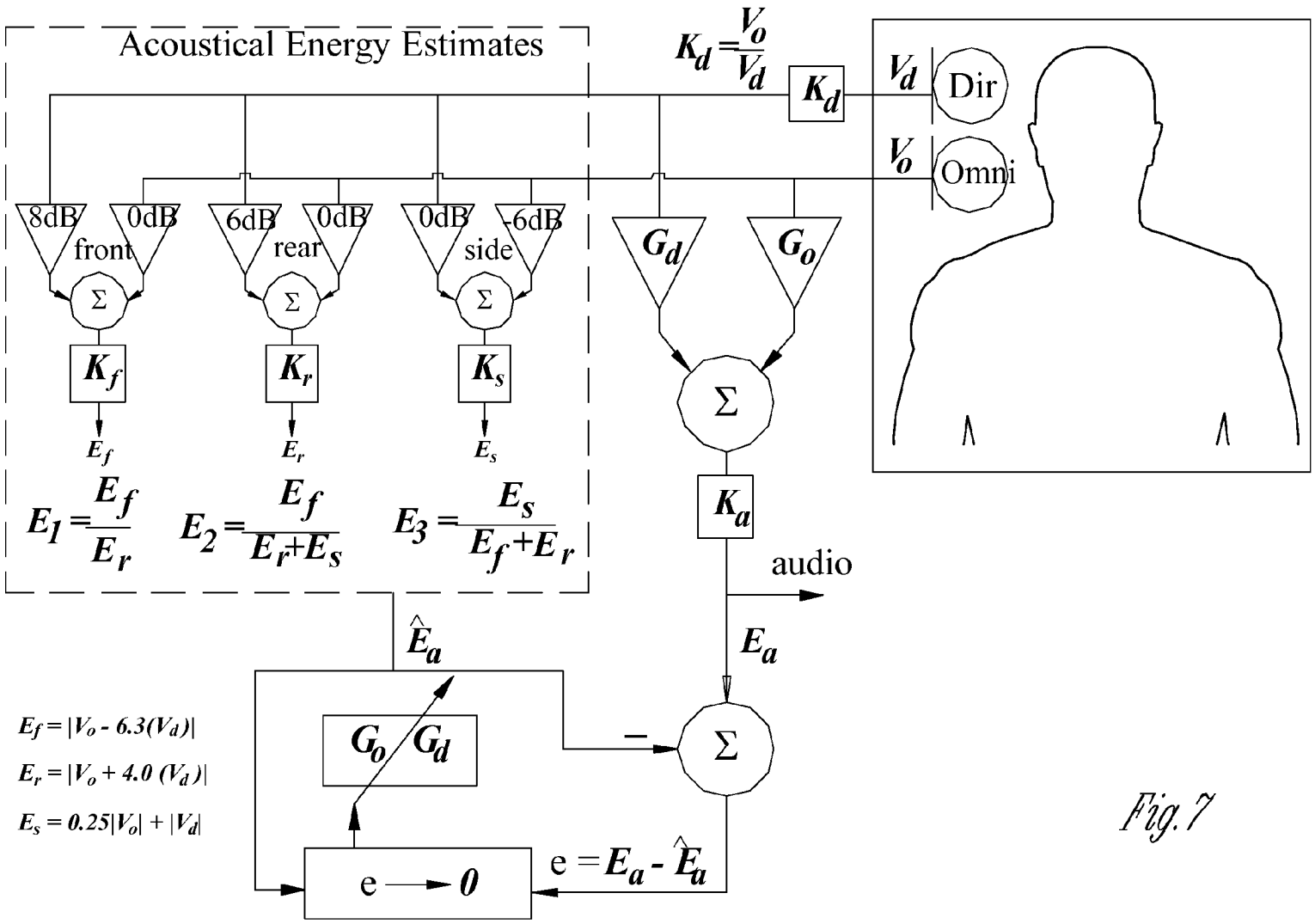
FIG. 7 illustrates a signal processing diagram for controlling the directional polar pattern of a hearing instrument based on ambient acoustical energy estimates according to one embodiment of the present subject matter.

A similar method is used FIG. 7, except that compensation filters are used either to provide unity gain or to normalize the energy estimates at various junctions of the algorithm. Kd is used to match the on-axis frequency response of the 1st-order differential mic to the frequency response of the omni mic. Kf, Kr, and Ks are used to normalize the ambient acoustical energy estimates. Ka is used to match the Blumlein (summed) on-axis frequency response to the frequency response of the omni mic.

Figure 8:
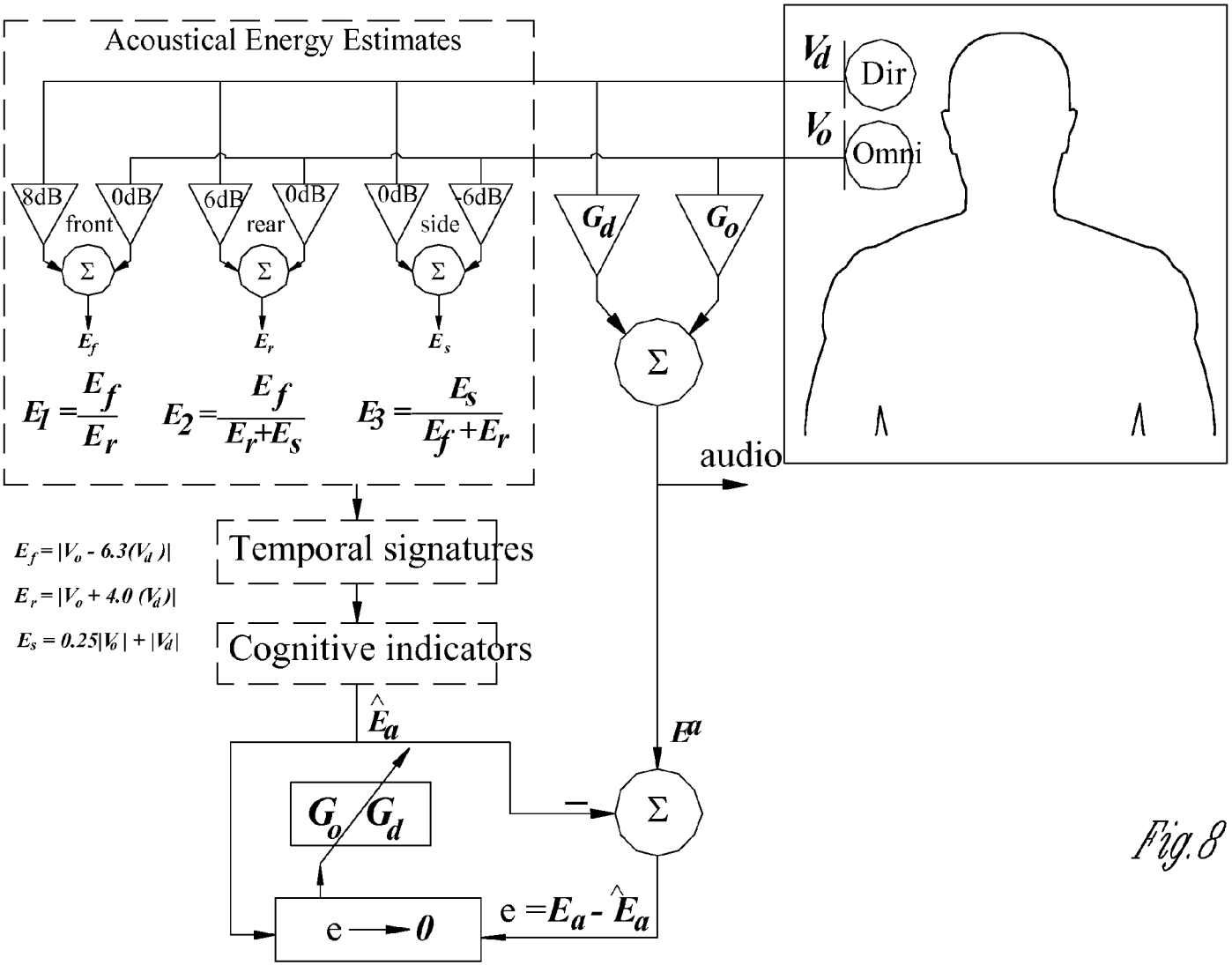
FIG. 8 illustrates a signal processing diagram for controlling the directional polar pattern of a hearing instrument based on ambient acoustical energy estimates according to one embodiment of the present subject matter.

The method of combining all of these signals can be influenced by independent temporal or cognitive estimates. For example, any time-signature algorithm that may classify ambient sound as a target rather than jammer may be used in this approach. Not only would the algorithm have the ability to quantify the direction of incoming ambient sound, but it could use the temporal and/or cognitive indicators to classify the type of sound: Is it noise? For more refined algorithms: Is it desired speech, i.e., a target? An example of using temporal signatures and/or cognitive indicators in the logic to determine the desired estimate $\hat{E}_a$ is shown in FIG. 8.

If binaural communication is available in the hearing instruments, the relative gains of the left hearing-instrument microphones can be combined with the relative gains of the right hearing-instrument microphones to yield additional energy estimates based on binaural polar patterns. For example, the microphone signals used to yield the data shown in FIG. 3 can be combined in equal proportion to the microphone signals from the opposite ear in order to provide an estimate for acoustic energy arriving from 0° on-axis. Similarly, the same can be done with the data from FIG. 4 in order to provide an estimate for acoustic energy arriving directly from the rear. Thus, estimates for acoustic energy arriving from eight different sectors have been discussed, however, it is understood that other numbers of sectors are possible without departing from the scope of the present subject matter.

Figure 9:
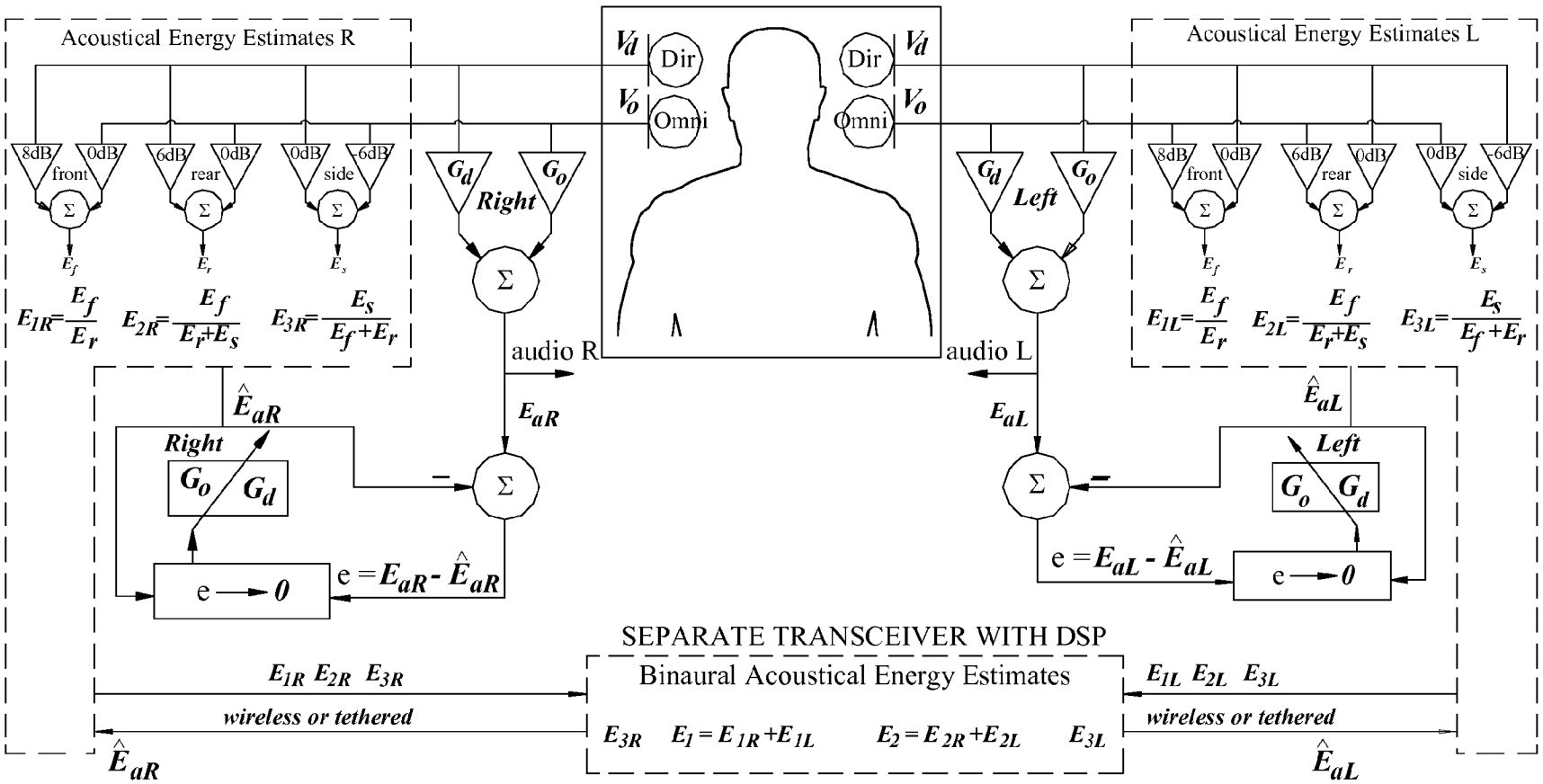
FIG. 9 illustrates a signal processing diagram for controlling the directional polar pattern of a hearing instrument based on ambient acoustical energy estimates according to one embodiment of the present subject matter.
Figure 10:
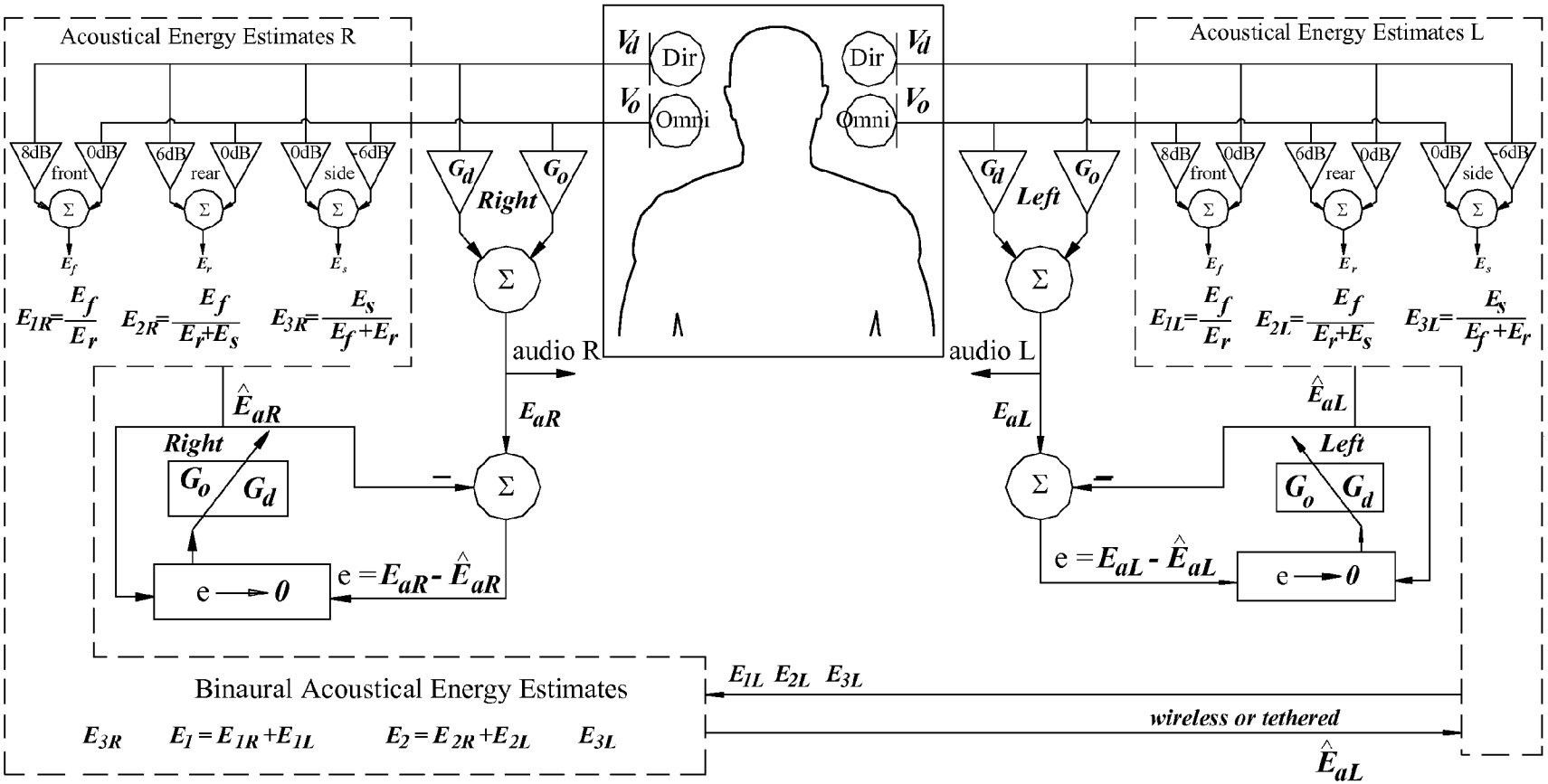
FIG. 10 illustrates a signal processing diagram for controlling the directional polar pattern of a hearing instrument based on ambient acoustical energy estimates according to one embodiment of the present subject matter.

In FIG. 9, a wireless or tethered connection is used to share information to/from the left and right hearing instruments to/from a separate transceiver hardware platform capable of its own DSP. In this example, the right and left acoustical energy ratio estimates are communicated to the transceiver platform, combined, and used to compute overall estimates. The left desired $\hat{E}_{aL}$ signal is communicated back to the left hearing instrument and used in a control algorithm as described previously in FIG. 6. The right desired signal is communicated back to the right hearing instrument in the same manner, and the control algorithm in the right hearing instrument behaves as described in FIG. 6. The left mic gains Gd and Go can be the same as or different than the right mic gains, depending on the logic used for the binaural acoustical energy estimates and the desired energy estimates $\hat{E}_{aL}$ and $\hat{E}_{aR}$. In FIG. 10, the left acoustical energy ratio estimates are communicated to the right hearing instrument and combined to compute overall estimates. The left desired $\hat{E}_{aL}$ signal is communicated back to the left hearing instrument and used in a control algorithm as described previously in FIG. 6. The right hearing instrument uses the additional energy estimates to further refine its desired estimate $\hat{E}_{aR}$. The control algorithm in the right hearing instrument behaves as described in FIG. 6. The left mic gains Gd and Go can be the same as or different than the right mic gains, depending on the logic used for the binaural acoustical energy estimates and the desired energy estimates $\hat{E}_{aL}$ and $\hat{E}_{aR}$.

Figure 11:
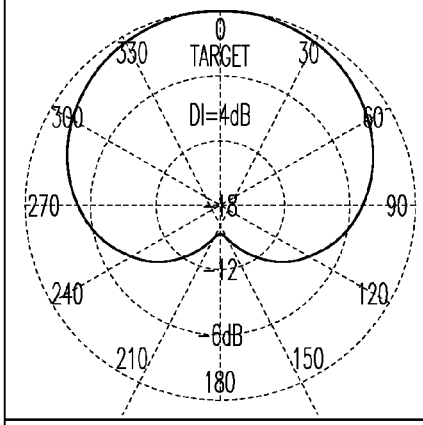
FIG. 11 illustrates the effects of microphone mismatch on the polar pattern of a Blumlein omni/bidirectional configuration.
Figure 11:
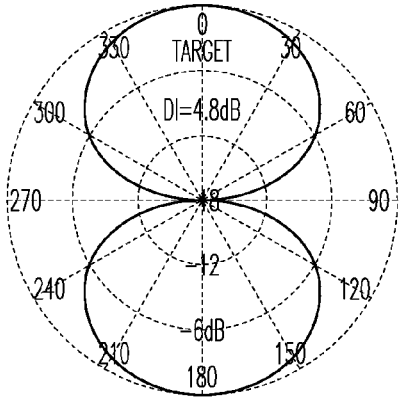
Figure 11:
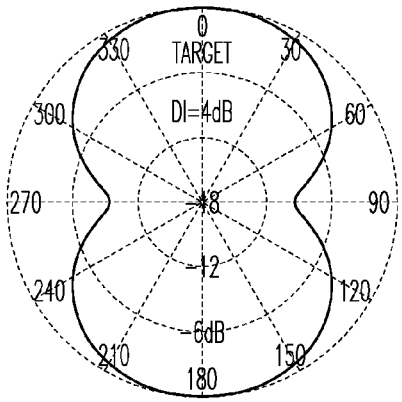

In Blumlein response patterns, the overall polar response is determined by the relative gain of the omni mic $G_o$ to the relative gain of the bidirectional mic $G_d$. Evaluating microphone drift, therefore, is synonymous to evaluating a drift in either $G_o$ or $G_d$. In order to achieve a freefield Blumlein hypercardioid response, the relative gain of the bidirectional mic $G_d$ must be 4.75 dB lower than the relative gain of the omni mic $G_o$. Microphone drift causes the 4.75 dB sensitivity offset to increase or decrease. If microphone drift decreases the offset from 4.75 dB to 0 dB, then the contribution from each mic is equal and the Blumlein hypercardioid shifts into a cardioid, regardless of whether the drift is in $G_o$ or $G_d$. Continuing, if the drift causes the offset to increase from 0 dB to 1.5 dB, the cardioid degrades toward an omni-ish pattern as shown in FIG. 11 with DI=4 dB. If the drift continues to increase from 1.5 dB to 9 dB, the pattern further degrades into an omni-ish pattern with DI=1 dB.

If, on the other hand, microphone drift causes the 4.75 dB sensitivity offset in the Blumlein hypercardioid to increase to 21 dB, the Blumlein response pattern simply shifts into the dominant bidirectional pattern with DI=4.8 dB. Thus, 16 dB in drift only causes 1.2 dB degradation in the DI as shown in FIG. 7.

Figure 2:
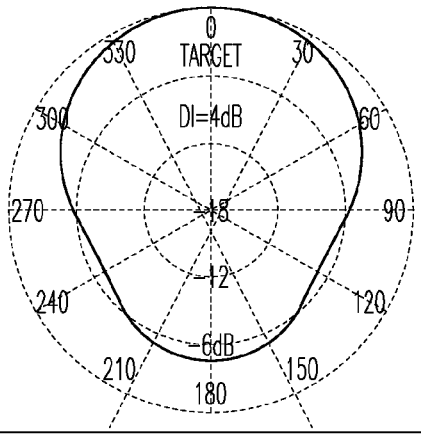
FIG. 2 illustrates the effects of channel mismatch on the polar pattern of a 1 cm-spaced endfire array.
Figure 2:
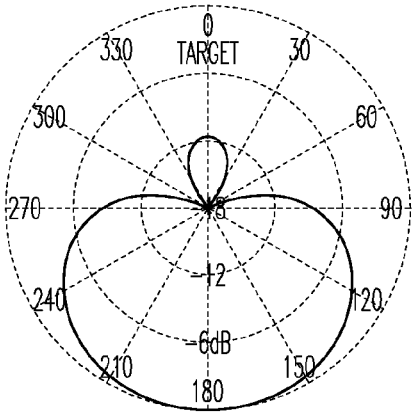

In contrast to the effects of mismatch in an endfire configuration, there are four things to note with a Blumlein configuration: 1) the primary effect of sensitivity mismatch is a shift in the null angle; the secondary effect is degradation in the null depth, 2) the primary effect of phase mismatch is a degradation in the null depth; the secondary effect is a shift in the null angle, 3) the 6.25 dB of sensitivity drift that produces 2 dB degradation in DI as shown in FIG. 11 is independent of frequency; this tolerance is much wider than the mismatch tolerance for the 1 cm spaced endfire shown in FIG. 2, and 4) the 90° of phase drift that produces a 2 dB degradation in DI as shown in FIG. 11 is independent of frequency; this tolerance is much wider than the mismatch tolerance for the 1 cm spaced endfire shown in FIG. 2.

Controlling the MRA of a Blumlein polar pattern can be accomplished by using at least two differential directional microphones and aligning their directional axes so that they are not collinear. Controlling the MRA on the azimuthal plane using a Blumlein configuration is better suited for a BTE than an ITE.

The relative microphone gains $G_o$ and $G_d$ can be implemented as digital filters, thereby allowing frequency dependent gain and phase. Frequency dependent filters would allow the Blumlein polar patterns to be executed independently in narrower frequency bands.

Figure 1:
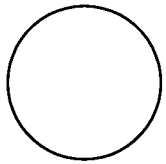
FIG. 1 illustrates the properties of typical, $1^{st}$-order directional patterns in spherically-diffuse noise.
Figure 1:
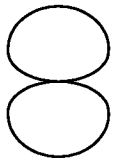
Figure 1:
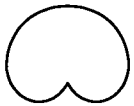
Figure 1:
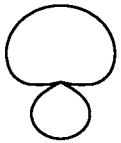
Figure 1:
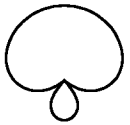

FIG. 1 illustrates the properties of typical, $1^{st}$-order directional patterns in spherically-diffuse noise. FIG. 2 illustrates the effects of channel mismatch on the polar pattern of a 1 cm-spaced endfire array. The top row depicts the effects due to sensitivity mismatch. The bottom row depicts the effects due to phase mismatch.

FIG. 3 illustrates KEMAR's in-situ, three-dimensional sensitivity pattern $E_f=|G_oH_o-G_dH_d|$ at 2 kHz of an ITE microphone system having an omnidirectional mic and a $1^{st}$-order bidirectional differential microphone when the relative microphone sensitivities are $G_d=G_o+8$ dB. This particular pattern provides an estimate for acoustic energy arriving from a front sector 30° off-axis. The data are normalized so that 0 dB coincides with the MRA; the sound energy contours are referenced to 0 dB.

FIG. 4 illustrates KEMAR's in-situ, three-dimensional sensitivity pattern $E_r=|G_oH_o+G_dH_d|$ at 2 kHz of an ITE microphone system having an omnidirectional mic and a $1^{st}$-order bidirectional differential microphone when the relative microphone sensitivities are $G_d=G_o+6$ dB. This particular pattern provides an estimate for acoustic energy arriving from a sector 30° off the rear axis. The data are normalized so that 0 dB coincides with the MRA; the sound energy contours are referenced to 0 dB.

FIG. 5 illustrates KEMAR's in-situ, three-dimensional sensitivity pattern $E_s=G_o|H_o|-G_d|H_d|$ at 2 kHz of an ITE microphone system having an omnidirectional mic and a $1^{st}$-order bidirectional differential microphone when the relative microphone sensitivities are $G_d=G_o+6$ dB. This particular pattern provides an estimate for acoustic energy arriving from a sector located on the same side as the ITE. The data are normalized so that 0 dB coincides with the MRA; the sound energy contours are referenced to 0 dB.

FIG. 6 illustrates a signal processing diagram for controlling the directional polar pattern of a hearing instrument based on ambient acoustical energy estimates, according to one embodiment of the present subject matter. The output signals from the omni and directional microphones are weighted by a certain gain and summed to compute estimates for acoustical energy arriving from the front, rear, and side. The front, rear, and side estimates are used to compute energy ratios, and these ratios are used to compute a desired acoustical energy estimate $\hat{E}_a$. The desired estimate $\hat{E}_a$ is compared to the user's audio output signal $E_a$ and also used in a control algorithm to adjust the relative mic gains $G_d$ and $G_o$ in order to minimize the error between $\hat{E}_a$ and $E_a$.

FIG. 7 illustrates a signal processing diagram for controlling the directional polar pattern of a hearing instrument based on ambient acoustical energy estimates, according to one embodiment of the present subject matter. It is the same as FIG. 6, with the exception that compensation filters are used either to provide unity gain or to normalize the energy estimates at various junctions of the algorithm. $K_d$ is used to match the on-axis frequency response of the $1^{st}$-order differential mic to the frequency response of the omni mic. $K_f$, $K_r$, and $K_s$ are used to normalize the ambient acoustical energy estimates. $K_a$ is used to match the Blumlein (summed) on-axis frequency response to the frequency response of the omni mic.

FIG. 8 illustrates a signal processing diagram for controlling the directional polar pattern of a hearing instrument based on ambient acoustical energy estimates, according to one embodiment of the present subject matter. It is the same as FIG. 6, except that temporal signatures and cognitive indicators are used in the logic to determine the desired estimate $\hat{E}_a$.

FIG. 9 illustrates a signal processing diagram for controlling the directional polar pattern of a hearing instrument based on ambient acoustical energy estimates, according to one embodiment of the present subject matter. It is the same as FIG. 6 except that a wireless or tethered connection is used to share information to/from the left and right hearing instruments to/from a separate transceiver hardware platform capable of its own DSP. In this example, the right and left acoustical energy ratio estimates are communicated to the transceiver platform, combined, and used to compute overall estimates. The left desired $\hat{E}_{aL}$ signal is communicated back to the left hearing instrument and used in a control algorithm as described previously in FIG. 6. The right desired signal is communicated back to the right hearing instrument in the same manner, and the control algorithm in the right hearing instrument behaves as described in FIG. 6. The left mic gains $G_d$ and $G_o$ can be the same as or different than the right mic gains, depending on the logic used for the binaural acoustical energy estimates and the desired energy estimates $\hat{E}_{aL}$ and $\hat{E}_{aR}$.

FIG. 10 illustrates a signal processing diagram for controlling the directional polar pattern of a hearing instrument based on ambient acoustical energy estimates, according to one embodiment of the present subject matter. It is the same as FIG. 6 except that a wireless or tethered connection is used to share information to/from the left and right hearing instruments in order to compute binaural acoustical energy ratio estimates. In this example, the left acoustical energy ratio estimates are communicated to the right hearing instrument and combined to compute overall estimates. The left desired $\hat{E}_{aL}$ signal is communicated back to the left hearing instrument and used in a control algorithm as described previously in FIG. 6. The right hearing instrument uses the additional energy estimates to further refine its desired estimate $\hat{E}_{aR}$. The control algorithm in the right hearing instrument behaves as described in FIG. 6. The left mic gains $G_d$ and $G_o$ can be the same as or different than the right mic gains, depending on the logic used for the binaural acoustical energy estimates and the desired energy estimates $\hat{E}_{aL}$ and $\hat{E}_{aR}$.

FIG. 11 illustrates the effects of microphone mismatch on the polar pattern of a Blumlein omni/bidirectional configuration. The top and middle rows depict the effects due to sensitivity mismatch; any sensitivity mismatch lower than the values shown will shift the null angle and improve the polar pattern towards a hypercardioid. In the top row, $G_O=G_d+1.5$ dB. In the middle row, $G_O=G_d-21$ dB. The bottom row depicts the effects due to phase mismatch; any phase mismatch lower than the values shown will increase the null depth, shift the null angle, and improve the polar pattern towards a hypercardioid.

ACRONYMS & DEFINITIONS

ASTM American Society for Testing and Materials.

BTE Behind the ear hearing instrument.

DI Directivity Index.

DSP Digital signal processing.

FTR Front to Total Random energy ratio.

$E_f$ Estimate for acoustical energy arriving from the front of KEMAR.

$E_r$ Estimate for acoustical energy arriving from the rear of KEMAR.

$E_s$ Estimate for acoustical energy arriving from the side of KEMAR.

$G_o$ Relative gain applied to an ITE omni mic.

$G_d$ Relative gain applied to an ITE directional mic.

$H_o$ 3D transfer functions of an ITE omni mic placed in situ on KEMAR. For this study, 614 transfer functions were collected at 10° resolution in azimuth and elevation as per ANSI 53.35.

$H_d$ 3D transfer functions of an ITE directional mic placed in situ on KEMAR. For this study, 614 transfer functions were collected at 10° resolution in azimuth and elevation as per ANSI 53.35.

$K_a$ Gain compensation filter to match the Blumlein audio output on-axis frequency response to the omni response.

$K_f$ Gain compensation filter to normalize the Blumlein acoustical energy estimate arriving from the front.

$K_r$ Gain compensation filter to normalize the Blumlein acoustical energy estimate arriving from the rear.

$K_s$ Gain compensation filter to normalize the Blumlein acoustical energy estimate arriving from the side.

$V_o$ Instantaneous voltage output from an omni mic.

$V_d$ Instantaneous voltage output from a directional mic.

ISO International Standards Organization.

ITE In the ear hearing instrument.

KEMAR Knowles Electronics Manikin for Acoustical Research.

LMSC Least mean squares control algorithm.

MRA The angle of maximum sensitivity response for a directional hearing instrument.

SNR Signal to Noise Ratio $T_{60}$ The time it takes steady state sound energy to decay 60 dB in a room.

UI Unidirectional Index.

One of ordinary skill in the art will understand that, the modules and other circuitry shown and described herein can be implemented using software, hardware, and combinations of software and hardware. As such, the terms module and circuitry, for example, are intended to encompass software implementations, hardware implementations, and software and hardware implementations.

The methods illustrated in this disclosure are not intended to be exclusive of other methods within the scope of the present subject matter. In various embodiments, the methods are implemented using a data signal embodied in a carrier wave or propagated signal, that represents a sequence of instructions which, when executed by one or more processors cause the processor(s) to perform the respective method. In various embodiments, the methods are implemented as a set of instructions contained on a computer-accessible medium capable of directing a processor to perform the respective method. In various embodiments, the medium is a magnetic medium, an electronic medium, or an optical medium.

The above detailed description is intended to be illustrative, and not restrictive. The scope of the invention should, therefore, be determined with reference to the appended claims, along with the full scope of equivalents to which such claims are entitled.

What is claimed is:

1. A method for computing estimates of level and incoming direction of ambient acoustical energy, comprising:

producing a first output from a directional microphone;

producing a second output from an omnidirectional microphone;

processing the first output and the second output to obtain energy estimates including a front estimate, a rear estimate, and a side estimate;

providing the front, rear, and side estimates to an adaptive filter; and combining the first output weighted by a first coefficient and the second output weighted by a second coefficient to produce an output signal, the output signal provided to the adaptive filter, wherein the first coefficient and the second coefficient are derived from the adaptive filter.

2. The method of claim 1, wherein processing the first output and the second output includes using a digital signal processor (DSP).

3. The method of claim 1, further comprising using compensation filters to provide unity gain.

4. The method of claim 1, further comprising using compensation filters to normalize the energy estimates.

5. The method of claim 1, further comprising using temporal signatures to obtain the energy estimates.

6. The method of claim 1, further comprising using cognitive indicators to obtain the energy estimates.

7. The method of claim 1, further comprising using binaural communication to combine relative gains of left hearing-instrument microphones with the relative gains of right hearing-instrument microphones.

8. The method of claim 7, wherein the relative gains of the left hearing-instrument microphones are the same as the relative gains of right hearing-instrument microphones.

9. The method of claim 7, wherein the relative gains of the left hearing-instrument microphones are different from the relative gains of right hearing-instrument microphones.

10. The method of claim 1, further comprising classifying an ambient sound as a target.

11. A hearing assistance system, comprising:

a directional microphone configured to provide a first output, an omnidirectional microphone configured to provide a second output;

a processor configured to receive the first and second output and to compute energy estimates including a front estimate, a rear estimate, and a side estimate using the first and second outputs;

an adaptive filter configured to receive the first and second outputs and the front, rear, and side estimates and to combine the first output weighted by a first coefficient and the second output weighted by a second coefficient to produce an output signal, wherein the first and second coefficients are derived using front, rear and side estimates.

12. The system of claim 11, wherein the processor is included in a hearing assistance device.

13. The system of claim 11, wherein the processor is included in an external device in communication with a hearing assistance device.

14. The system of claim 13, wherein the external device and the hearing assistance device communicate wirelessly.

15. The system of claim 11, further comprising compensation filters configured to provide unity gain.

16. The system of claim 11, further comprising compensation filters configured to normalize the energy estimates.

17. The system of claim 11, further comprising temporal signatures configured to obtain energy estimates.

18. The system of claim 11, further comprising cognitive indicators configured to obtain energy estimates.

19. The system of claim 11, wherein the system includes more than one hearing instrument.

20. The system of claim 19, wherein the system includes a left hearing instrument in wireless communication with a right hearing instrument.

* * * * *

UNITED STATES PATENT AND TRADEMARK OFFICE

CERTIFICATE OF CORRECTION

PATENT NO. : 8,744,101 B1
APPLICATION NO. : 12/631436
DATED : June 3, 2014
INVENTOR(S) : Thomas Howard Burns It is certified that error appears in the above-identified patent and that said Letters Patent is hereby corrected as shown below:

On the title page, in column 2, under "Other Publications", line 2, delete "Transaactions" and insert --Transactions--, therefor Signed and Sealed this
Second Day of December, 2014

Michelle K. Lee

Michelle K. Lee
*Deputy Director of the United States Patent and Trademark Office*